US009454167B2

(12) United States Patent
Potanin et al.

(10) Patent No.: US 9,454,167 B2
(45) Date of Patent: Sep. 27, 2016

(54) SCALABLE VOLTAGE REGULATOR TO INCREASE STABILITY AND MINIMIZE OUTPUT VOLTAGE FLUCTUATIONS

(71) Applicant: Vivid Engineering, Inc., San Jose, CA (US)

(72) Inventors: Vladislav Potanin, San Jose, CA (US); Elena Potanina, San Jose, CA (US)

(73) Assignee: VIVID ENGINEERING, INC., San Jose, CA (US)

( * ) Notice: Subject to any disclaimer, the term of this patent is extended or adjusted under 35 U.S.C. 154(b) by 214 days.

(21) Appl. No.: 14/287,202

(22) Filed: May 27, 2014

(65) Prior Publication Data

US 2015/0207406 A1 Jul. 23, 2015

Related U.S. Application Data

(60) Provisional application No. 61/929,935, filed on Jan. 21, 2014.

(51) Int. Cl.

| | |
|---|---|
| ***G05F 1/575*** | (2006.01) |
| ***G05F 1/618*** | (2006.01) |
| *G05F 1/46* | (2006.01) |

(52) U.S. Cl.

CPC ..... *G05F 1/575* (2013.01); *G05F 1/618* (2013.01); *G05F 1/465* (2013.01)

(58) Field of Classification Search

CPC ..... H02M 2001/0025; G05F 1/462; G05F 1/465; G05F 1/56; G05F 1/575

See application file for complete search history.

(56) References Cited

U.S. PATENT DOCUMENTS

| | | | | |
|---|---|---|---|---|
| 6,046,577 | A * | 4/2000 | Rincon-Mora | G05F 1/575 323/279 |
| 6,300,749 | B1 * | 10/2001 | Castelli | G05F 1/575 323/273 |
| 6,603,292 | B1 * | 8/2003 | Schouten | G05F 1/573 323/274 |
| 6,977,490 | B1 * | 12/2005 | Zhang | G05F 1/575 323/280 |
| 7,723,968 | B2 | 5/2010 | Okuyama et al. | |
| 7,843,180 | B1 | 11/2010 | Cilingiroglu | |
| 7,893,671 | B2 | 2/2011 | Sahni et al. | |
| 7,902,801 | B2 | 3/2011 | Mandal | |
| 8,054,055 | B2 | 11/2011 | Mandal | |
| 8,154,263 | B1 | 4/2012 | Shi et al. | |
| 8,154,265 | B2 | 4/2012 | Napravnik | |

(Continued)

OTHER PUBLICATIONS

Jacobs, "CMOS circuit design, layout, and simulation", Second edition, Wiley, Published on Jan. 16 2005.

*Primary Examiner* — Fred E Finch, III

(74) *Attorney, Agent, or Firm* — Turk IP Law, LLC

(57) ABSTRACT

Technologies are generally described for a voltage regulator implemented as an integrated circuit (IC). The voltage regulator may include a power transistor configured to receive and convert an input voltage from a voltage source to an output voltage, and a feedback loop configured to regulate the output voltage in response to a change from a desired level. The feedback loop may include an error amplifier configured to determine and amplify a value difference between the output voltage and a reference output voltage, a voltage divider configured to generate voltage proportional to the output voltage such that a ratio is the value difference, and a first unity gain buffer configured to increase stability of the IC. In some examples, the feedback loop may include a second unity gain buffer and/or an overshoot suppressor circuit configured to reduce an output voltage fluctuation when a current consumed by the load is changed suddenly.

19 Claims, 6 Drawing Sheets

(56) References Cited

U.S. PATENT DOCUMENTS

| | | | | |
|---|---|---|---|---|
| 8,159,207 | B2 | 4/2012 | Ivanov et al. | |
| 8,169,203 | B1 | 5/2012 | Vemula | |
| 8,222,877 | B2 | 7/2012 | Cerchi et al. | |
| 8,242,761 | B2 | 8/2012 | Napravnik | |
| 8,289,009 | B1 | 10/2012 | Strik et al. | |
| 8,305,066 | B2 | 11/2012 | Lin et al. | |
| 8,324,876 | B1 | 12/2012 | Le et al. | |
| 8,344,713 | B2 | 1/2013 | Shrivas et al. | |
| 8,760,133 | B2 * | 6/2014 | Hasegawa | G05F 1/575 323/273 |
| 2003/0102851 | A1 * | 6/2003 | Stanescu | G05F 1/575 323/280 |
| 2003/0178976 | A1 * | 9/2003 | Xi | G05F 1/575 323/273 |
| 2004/0004468 | A1 * | 1/2004 | Dearn | G05F 1/575 323/280 |
| 2006/0170404 | A1 * | 8/2006 | Amrani | G05F 1/565 323/282 |
| 2009/0009147 | A1 * | 1/2009 | Jian | G05F 1/575 323/280 |
| 2012/0299564 | A1 * | 11/2012 | Howes | G05F 1/575 323/281 |
| 2013/0257401 | A1 * | 10/2013 | Fort | G05F 1/46 323/280 |
| 2014/0266104 | A1 * | 9/2014 | El-Nozahi | G05F 1/575 323/280 |

* cited by examiner

SCALABLE VOLTAGE REGULATOR TO INCREASE STABILITY AND MINIMIZE OUTPUT VOLTAGE FLUCTUATIONS

CROSS-REFERENCE TO RELATED APPLICATIONS

This Application claims priority to U.S. Provisional Application Ser. No. 61/929,935 filed on Jan. 21, 2014. The Provisional Application is herein incorporated by reference in its entirety.

BACKGROUND

Unless otherwise indicated herein, the materials described in this section are not prior art to the claims in this application and are not admitted to be prior art by inclusion in this section.

Current voltage regulators implemented as integrated circuits (ICs) may include an error amplifier, a power device, and a feedback, for example. The purpose of the voltage regulator may be to maintain an output voltage at a particular value regardless of a fluctuation in current consumed by a load of the IC. The voltage regulator may maintain the output voltage by implementing a regulation loop to sense a difference of the output voltage from the particular value and adjust conductivity of the power device in order to compensate for the sensed difference. Current attempts to design such voltage regulators may face operational difficulties, such as lack of stability under a variety of operating conditions, and transient output voltage fluctuations in response to a sudden change in the current consumed by a load of the IC.

SUMMARY

The present disclosure generally describes techniques to implement a voltage regulator as an integrated circuit (IC), where a design of the voltage regulator may be configured to increase a stability of the IC and minimize fluctuations in output voltage in response to sudden changes in a current consumed by a load of the IC.

According to some examples, voltage regulators are described. An example voltage regulator may include a power transistor configured to receive an input voltage from a voltage source and convert the input voltage to an output voltage, and a feedback loop configured to regulate the output voltage in response to a change of output voltage from a desired level caused by a change of a current consumed by a load or changes of other operating conditions. The feedback loop may include an error amplifier configured to determine and amplify a value difference between the output voltage or portion of the output voltage and a reference voltage. The feedback loop may also include a voltage divider, where an input of the voltage divider may be coupled to an output of the voltage regulator, and an output of the voltage divider may be coupled to an input of the error amplifier. The voltage divider may be configured to receive an output voltage of the voltage regulator, and generate voltage proportional to an input voltage of the voltage divider with a specific ratio. The feedback loop may further include a unity gain buffer coupled to the power transistor and the error amplifier. The unity gain buffer may be configured to receive a first control signal based on the output voltage of the error amplifier, and provide a second control signal to the power transistor without signal amplification or attenuation.

According to other examples, voltage regulators are described. An example voltage regulator may include a power transistor configured to receive an input voltage from a voltage source and convert the input voltage to an output voltage, and a feedback loop configured to regulate the output voltage in response to a change of output voltage from a desired level caused by a change of a current consumed by a load or changes of other operating conditions. The feedback loop may include an error amplifier configured to determine and amplify a value difference between the output voltage or portion of the output voltage and a reference voltage. The feedback loop may also include a voltage divider, where an input of the voltage divider may be coupled to an output of the voltage regulator, and an output of the voltage divider may be coupled to an input of the error amplifier. The voltage divider may be configured to receive an output voltage of the voltage regulator, and generate voltage proportional to an input voltage of the voltage divider with a specific ratio. The feedback loop may further include a first unity gain buffer coupled to the power transistor and the error amplifier. The first unity gain buffer may be configured to receive a first control signal based on the output voltage of the error amplifier, and provide a second control signal to the power transistor without signal amplification or attenuation. The feedback loop may yet further include a second unity gain buffer coupled to the power transistor, where the second unity gain buffer may be configured to reduce an output voltage drop when the current consumed by the load is changed from a low current to a high current.

According to further examples, voltage regulators are described. An example voltage regulator may include a power transistor configured to receive an input voltage from a voltage source and convert the input voltage to an output voltage, and a feedback loop configured to regulate the output voltage in response to a change of output voltage from a desired level caused by a change of a current consumed by a load or changes of other operating conditions. The feedback loop may include an error amplifier configured to determine and amplify a value difference between the output voltage or portion of the output voltage and a reference voltage. The feedback loop may also include a voltage divider, where an input of the voltage divider may be coupled to an output of the voltage regulator, and an output of the voltage divider may be coupled to an input of the error amplifier. The voltage divider may be configured to receive an output voltage of the voltage regulator, and generate voltage proportional to an input voltage of the voltage divider with a specific ratio. The feedback loop may further include a first unity gain buffer coupled to the power transistor and the error amplifier. The first unity gain buffer may be configured to receive a first control signal based on the output voltage of the error amplifier, and provide a second control signal to the power transistor without signal amplification or attenuation. The feedback loop may yet further include a second unity gain buffer coupled to the power transistor, where the second unity gain buffer may be configured to reduce an output voltage drop when the current consumed by the load is changed from a low current to a high current. The feedback loop may also include an overshoot suppressor circuit coupled to the load in a parallel orientation to the load, where the overshoot suppressor circuit may be configured to reduce an output voltage rise when the current consumed by the load is changed from a high current to a low current.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
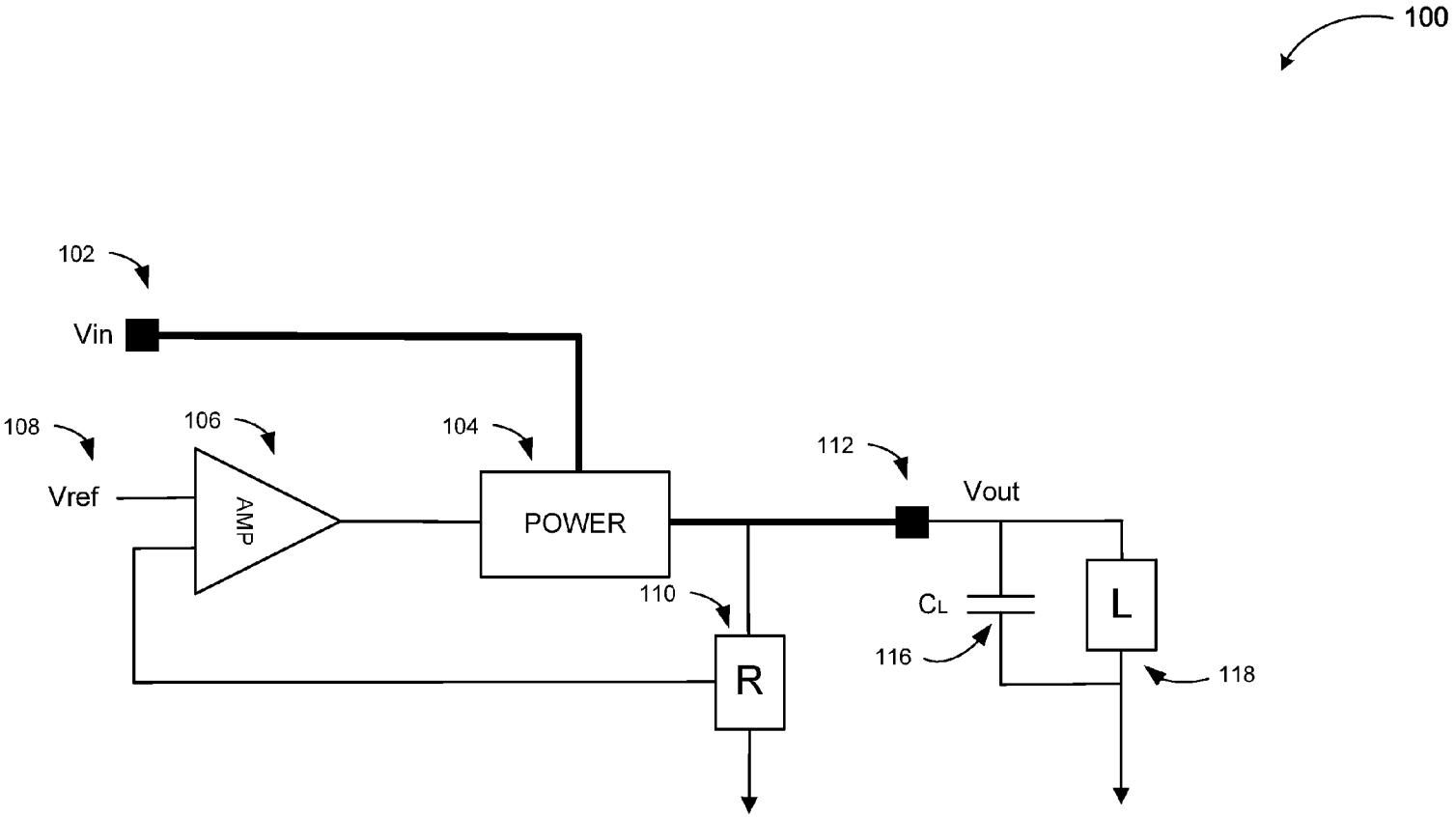
FIG. 1 illustrates an example configuration of a standard voltage regulator.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. The aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems, devices, and/or computer program products related to a voltage regulator implemented as an integrated circuit (IC), where a design of the voltage regulator may be configured to increase a stability of the IC and minimize fluctuations in output voltage in response to sudden changes in a current consumed by a load of the IC.

Briefly stated, technologies are generally described for a voltage regulator implemented as an IC. The voltage regulator may include a power transistor configured to receive and convert an input voltage from a voltage source to an output voltage, and a feedback loop configured to regulate the output voltage in response to a change from a desired level. The feedback loop may include an error amplifier configured to determine and amplify a value difference between the output voltage and a reference output voltage, a voltage divider configured to generate voltage proportional to the output voltage such that a ratio is the value difference, and a first unity gain buffer configured to increase stability of the IC. In some examples, the feedback loop may include a second unity gain buffer and/or an overshoot suppressor circuit configured to reduce an output voltage fluctuation when a current consumed by the load is changed suddenly.

FIG. 1 illustrates an example configuration of a standard voltage regulator, arranged in accordance with at least some embodiments described herein.

As shown in a diagram 100, a standard voltage regulator implemented as an IC may include a power device 104, an error amplifier 106, and a voltage divider 110. An output of the voltage regulator may be coupled to a load 118 of the IC in a particular orientation, such as a serial orientation.

An input of the voltage divider 110 may be coupled to the output of the voltage regulator, and an output of the voltage divider 110 may be coupled to an input of the error amplifier 106. An output of the error amplifier 106 may be coupled to the power device 104, which may be coupled to both an input and the output of the voltage regulator, forming a feedback loop providing regulation of output voltage 112.

The power device 104 may be a power transistor, for example, and may receive an input voltage 102 from a voltage source. The power device 104 may convert the input voltage 102 to the output voltage 112, which may be the output voltage 112 of the voltage regulator. The voltage divider 110 may be configured to receive the output voltage 112 of the voltage regulator, and generate voltage proportional to an input voltage of the voltage divider (output voltage 112 of the voltage regulator) with a specific ratio. The specific ratio may be determined by the characteristics of the voltage divider's components, for example, values of the resistors in a resistive voltage divider.

The error amplifier 106 may be configured to determine a value difference of the output voltage 112 or at least a portion of the output voltage 112 and a reference output voltage 108. The reference output voltage 108 may be a desired output voltage level, for example. Once the value difference is determined, the error amplifier 106 may amplify a signal control based on the value difference, and provide the signal control to the power device 104. A conductivity of the power device 104 may be adjusted based on the provided signal control such that the value difference may be eliminated between the output voltage 112 and the reference output voltage 108.

As discussed previously, the output of the voltage regulator may be coupled to a load 118 of the IC. Sudden changes in a current consumed by the load 118 may affect the load capacitance 116, which in turn may cause transient fluctuations of the output voltage 112 of the voltage regulator. In other examples, sudden changes in other operating conditions of the IC may cause transient fluctuations of the output voltage 112 of the voltage regulator. As the purpose of the voltage regulator is to maintain the output voltage 112 at a particular value, these transient fluctuations of output voltage 112 in response to a change in current consumed by the load 118 may present flaws in the design of the current voltage regulator. It may be valuable to improve a design of the voltage regulator in order to minimize the transient fluctuations of the output voltage 112.

Figure 2:
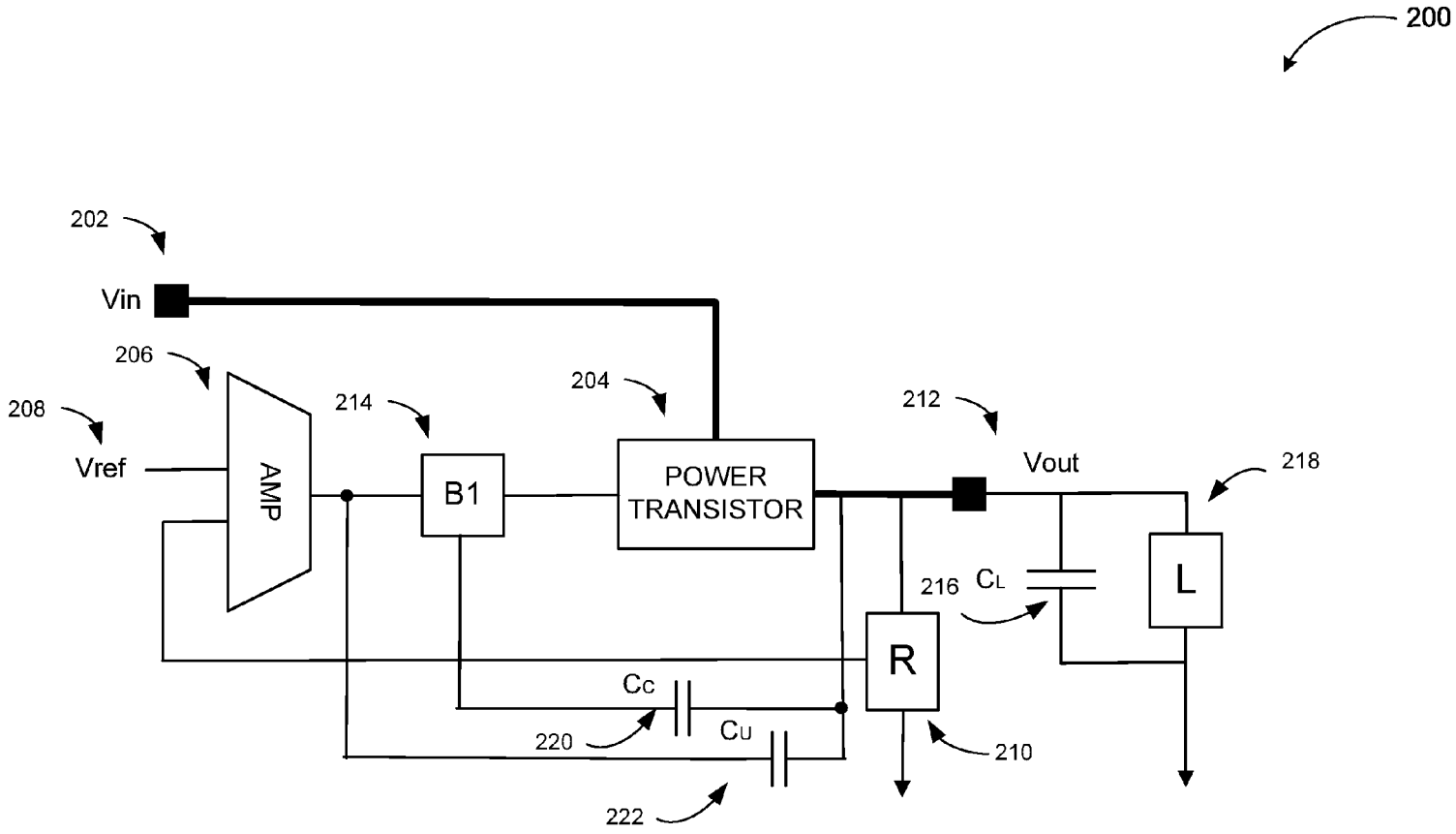
FIG. 2 illustrates an example voltage regulator with increased stability.

FIG. 2 illustrates an example voltage regulator with increased stability, arranged in accordance with at least some embodiments described herein.

As shown in a diagram 200, a voltage regulator implemented as an IC may include a power transistor 204, an error amplifier 206, a voltage divider 210, a unity gain buffer 214 and one or more compensation capacitors 220 and 222. An output of the voltage regulator may be coupled to a load 218 of the IC in a particular orientation, such as a serial orientation.

An input of the voltage divider 210 may be coupled to the output of the voltage regulator, and an output of the voltage divider 210 may be coupled to an input of the error amplifier 206. An output of the error amplifier 206 may be coupled to the power transistor 204, which may be coupled to both an input and the output of the voltage regulator, forming a feedback loop providing regulation of output voltage 212.

The power transistor 204 may receive an input voltage 202 from a voltage source. The power transistor 204 may convert the input voltage 202 to an output voltage 212, which may be the output voltage 212 of the voltage regulator. A size of the power transistor 204 may be selected based on a maximum load current and a minimum input voltage requirement, selected based on one or more design rules, and/or selected such that multiplication is enabled, for example.

The voltage divider 210 may be a resistive divider, for example. The voltage divider 210 may be configured to receive the output voltage 212 of the voltage regulator, and generate voltage proportional to an input voltage of the voltage divider (output voltage 212 of the voltage regulator) with a specific ratio. The error amplifier 206 may be an operational trans-conductance amplifier (OTA), for example. The error amplifier 206 may be configured to determine a value difference of the output voltage 212 or at least a portion of the output voltage 212 and a reference output voltage 208. The reference output voltage 208 may be a desired output voltage level, for example. Once the value difference is determined, the error amplifier 206 may amplify a first signal control based on the value difference.

The unity gain buffer 214 coupled to the power transistor 204 and the error amplifier 206 may be configured to receive the first control signal from the error amplifier, and provide a second control signal to the power transistor 204. The second control signal may be provided without signal amplification or attenuation of the second control signal, which may provide stability to the IC under a variety of operating conditions, such as a range of load capacitance 216 values. For example, the load capacitance 216 values may range from a few pF to several hundred μF. The unity gain buffer 214 may be a transistor in a common base configuration or a transistor in a common gate configuration, for example. A conductivity of the power transistor 204 may be adjusted based on the provided second signal control such that the value difference may be eliminated between the output voltage 212 and the reference output voltage 208.

The voltage regulator may further include the compensation capacitors 220 and 222 to provide further stability to the IC. The compensation capacitor 222 between an output of the error amplifier 206 and an output of the voltage regulator may change a frequency response of the error amplifier 206 such that overall transfer function of the regulation loop may confirm to stability criteria. For example, the stability criteria may be a phase shift less than 180 degrees minus adequate margin (i.e., at least 20 degree) at a frequency where open loop gain decreases to zero decibel. The compensation capacitor 220 may be coupled to an output of the unity gain buffer 214 and an output of the voltage regulator, to serve as an additional alternating current (AC) regulation loop for fast transitions.

Figure 3:
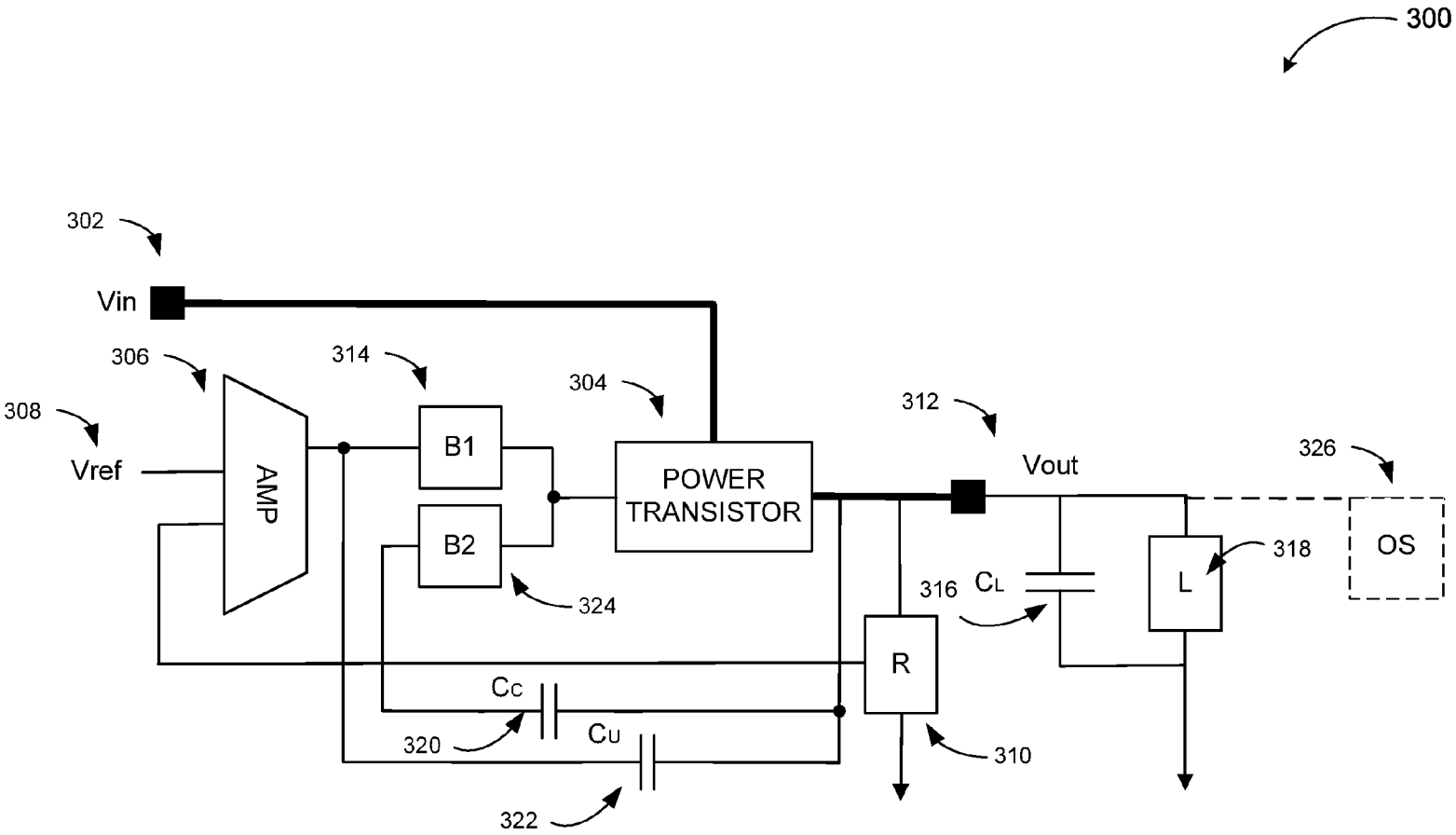
FIG. 3 illustrates an example voltage regulator with increased stability that enables output voltage fluctuations to be minimized in response to a change in load from a low level to a high level.

FIG. 3 illustrates an example voltage regulator with increased stability that enables output voltage fluctuations to be minimized in response to a change in load from a low level to a high level, arranged in accordance with at least some embodiments described herein.

As shown in a diagram 300, a voltage regulator implemented as an IC may include a power transistor 304, an error amplifier 306, a voltage divider 310, a first unity gain buffer 314, a second unity gain buffer 324, and one or more compensation capacitors 320 and 322. An output of the power transistor 304 may be coupled to a load 318 of the IC in a particular orientation, such as a serial orientation.

An input of the voltage divider 310 may be coupled to the output of the voltage regulator, and an output of the voltage divider 310 may be coupled to an input of the error amplifier 306. An output of the error amplifier 306 may be coupled to the power transistor 304, which may be coupled to both an input and the output of the voltage regulator, forming a feedback loop providing regulation of output voltage 312.

The power transistor 304 may receive an input voltage 302 from a voltage source. The power transistor 304 may convert the input voltage 302 to an output voltage 312, which may be the output voltage 312 of the voltage regulator. A size of the power transistor 304 may be selected based on a maximum load current and a minimum input voltage requirement, selected based on one or more design rules, and/or selected such that multiplication is enabled, for example.

The voltage divider 310 may be a resistive divider configured to receive the output voltage 312 of the voltage regulator, and generate voltage proportional to an input voltage of the voltage divider with a specific ratio. The error amplifier 306 may be an OTA configured to determine a value difference of the output voltage 312 or at least a portion of the output voltage 312 and a reference output voltage 308. The reference output voltage 308 may be a desired output voltage level, for example. Once the value difference is determined, the error amplifier 306 may amplify a first signal control based on the value difference.

The first unity gain buffer 314 coupled to the power transistor 304 and the error amplifier 306 may be configured to receive the first control signal from the error amplifier, and provide a second control signal to the power transistor 304. The second control signal may be provided without signal amplification or attenuation of the second control signal, which may provide stability to the IC under a variety of operating conditions, such as a range of load capacitance 316 values. For example, the load capacitance 316 values may range from a few pF to several hundred μF. The first unity gain buffer 314 may be a transistor in a common base configuration or a transistor in a common gate configuration, for example. A conductivity of the power transistor 304 may then be adjusted based on the provided second signal control such that the value difference may be eliminated between the output voltage 312 and the reference output voltage 308.

The voltage regulator may further include the compensation capacitors 320 and 322 to provide further stability to the IC. The compensation capacitor 322 between an output of the error amplifier 306 and an output of the voltage regulator may change a frequency response of the error amplifier 306 such that overall transfer function of the regulation loop may confirm to stability criteria. For example, the stability criteria may be a phase shift less than 180 degrees minus adequate margin (i.e., at least 20 degree) at a frequency where open loop gain decreases to zero decibel. The compensation capacitor 320 may be coupled to an output of the first unity gain buffer 314 and an output of the voltage regulator, to serve as an additional AC regulation loop for fast transitions.

As discussed previously, the output of the power transistor 304 may be coupled to a load 318 of the IC. Sudden changes in a current consumed by the load 318 may affect the load capacitance 316, which in turn may cause transient fluctuations of the output voltage 312 of the power transistor 304.

Introduction of the second unity gain buffer 324 may minimize these transient fluctuations, where the second unity gain buffer 324 may be coupled to the power transistor 304. For example, the second unity gain buffer 324 may reduce a drop in the output voltage when a current consumed by the load 318 suddenly changes from a low current to a high current, also termed undershoot. The second unity gain buffer 324, similar to the first unity gain buffer 314, may be a transistor in a common base configuration or a transistor in a common gate configuration, for example.

In some embodiments, a range of scaling factors may be identified for the power transistor 304, the error amplifier 306, the first unity gain buffer 314, the second unity gain buffer 324, and the compensation capacitor 320. Coefficients of the scaling factors may be determined through an empirical formulation and/or by running a circuit simulation for one or more combinations of the scaling factors. The combination scaling coefficients may be selected based on parameters. Some example parameters may include target output voltage, minimum and maximum input voltage, maximum load current, minimal and maximal load capacitance, and maximum instant change of the load current.

In other embodiments, an optional overshoot suppressor circuit 326 may be coupled to the load 318 in a parallel orientation, as illustrated in FIG. 3. The optional overshoot suppressor circuit 326 may be configured to reduce a rise in the output voltage when a current consumed by the load 318 suddenly changes from a high current to a low current, termed an overshoot.

Figure 4:
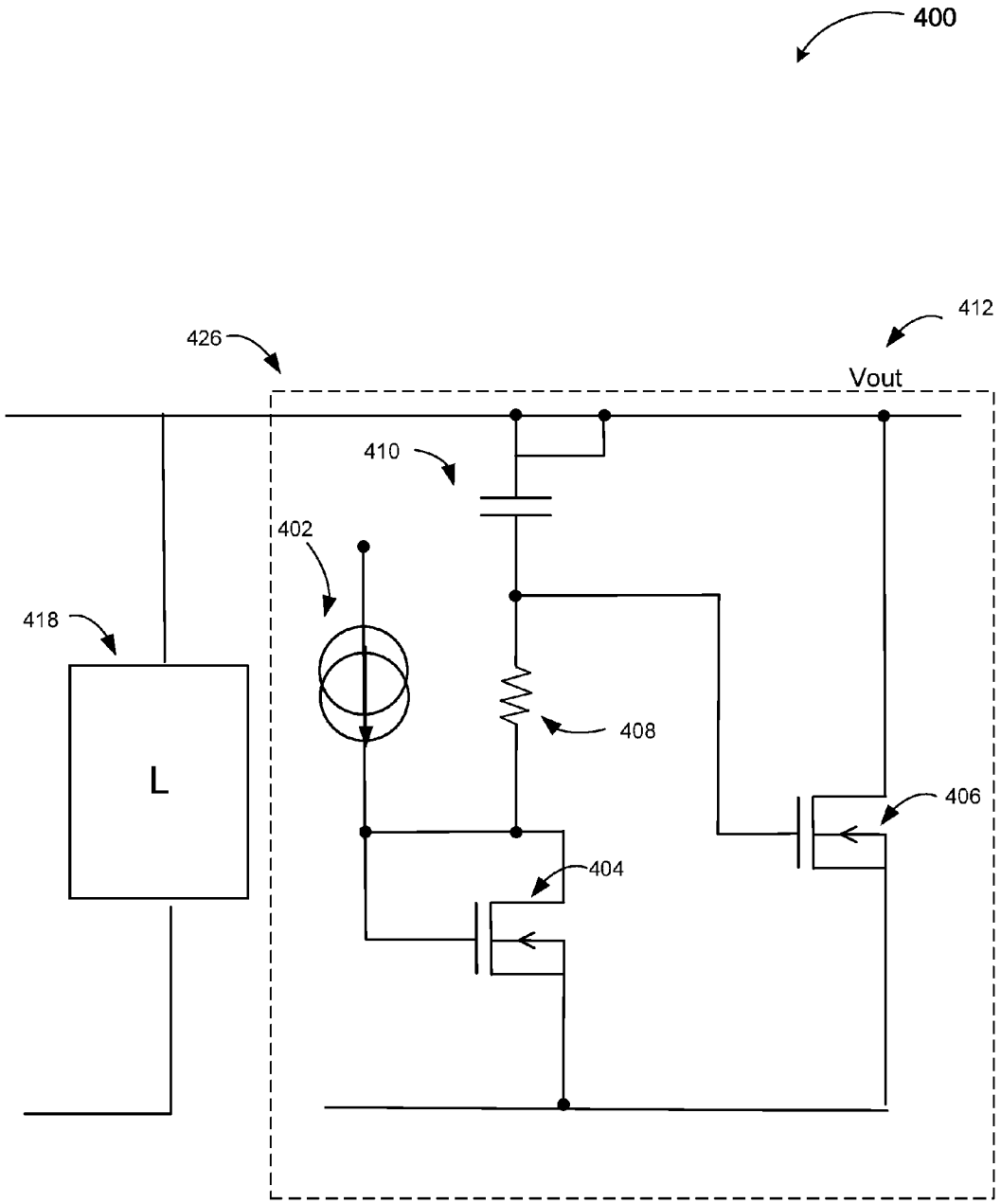
FIG. 4 illustrates an example voltage regulator coupled with an overshoot suppressor circuit.

FIG. 4 illustrates an example voltage regulator coupled with an overshoot suppressor circuit, arranged in accordance with at least some embodiments described herein.

As shown in a diagram 400, an overshoot suppressor circuit 426 may include a current source 402, one or more transistors 404 and 406, a resistor 408, and a capacitor 410. The overshoot suppressor circuit 426 may be coupled to a load 418 of a voltage regulator implemented as an IC, such as the voltage regulator described previously in FIG. 3. The overshoot suppressor circuit 426 may further be coupled to a load 418 in a parallel orientation.

As discussed previously, sudden changes in a current consumed by the load 418 may cause transient fluctuations of an output voltage 412. The overshoot suppressor circuit 426 may be configured to reduce a rise of the output voltage 412 when a current consumed by the load 418 suddenly changes from a high current to a low current, termed an overshoot.

Within the overshoot suppressor circuit 426, the current source 402 may be coupled to at least one transistor, such as transistor 404, and the resistor 408. The resistor 408 may further be coupled to the transistor 404, the transistor 406, and the capacitor 410. The transistors 404 and 406 may be field-effect transistors (FETs), for example. More specifically, the transistors 404 and 406 may be N-type metal-oxide-semiconductor logic (NMOS) transistors or P-type metal-oxide-semiconductor logic (PMOS) transistors, where the PMOS transistors are in a mirrored configuration. The NMOS transistors may be preferred due to a driving capability over double a magnitude of the PMOS transistors of comparable size.

The capacitor 410 may have a capacitance value (C) ten times greater than a value of a gate capacitance of the transistor 406. The resistor 408 may be selected such that the resistance value (R) enables a time constant in equation t=RC to be about two to four times of the response time of the main regulation loop. For example, C may be in a range from about 1 pF to about 20 pF, and R may be in a range from about 20 kOhm to about 500 kOhm.

Figure 5A:
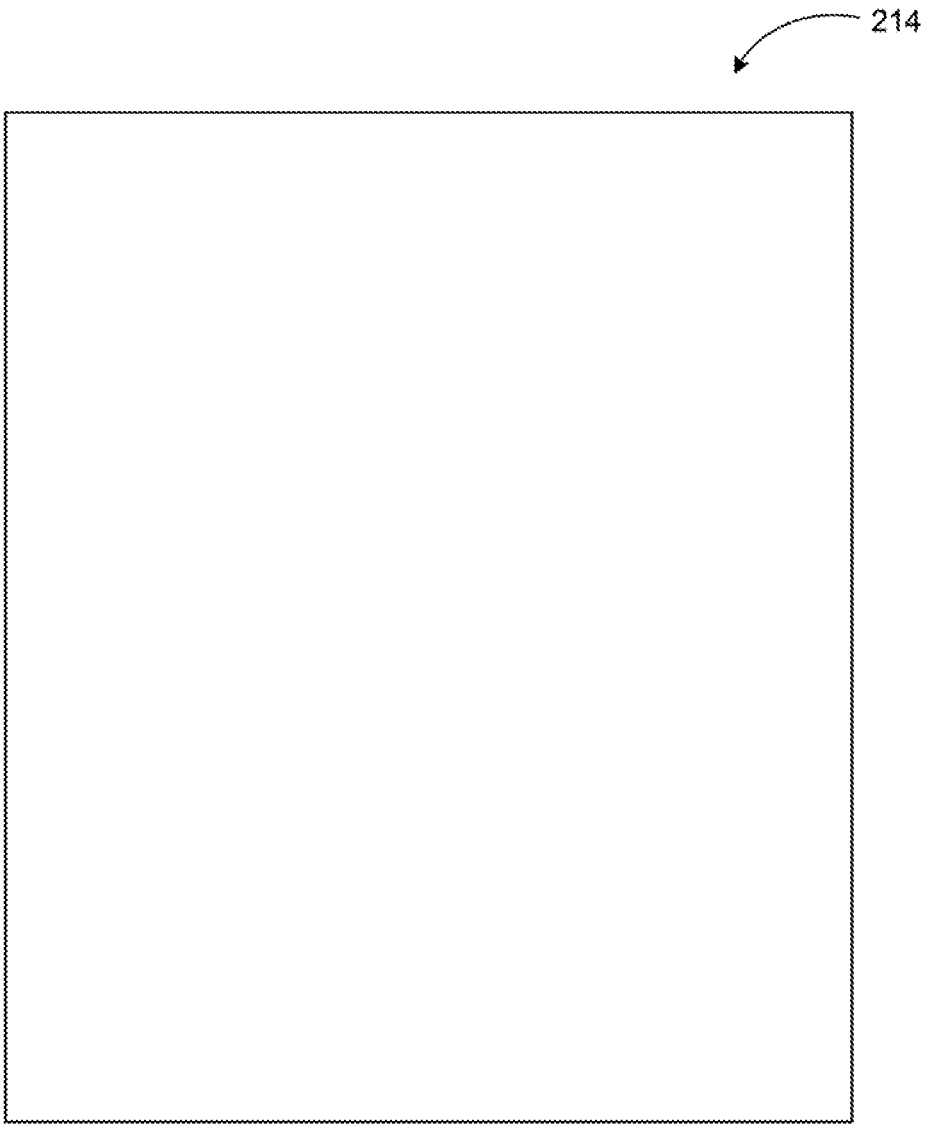
FIGS. 5A and 5B illustrate common gate and common base configuration implementations of the unity gain buffer of FIG. 2 and FIG. 3, all arranged in accordance with at least some embodiments described herein.
Figure 5B:
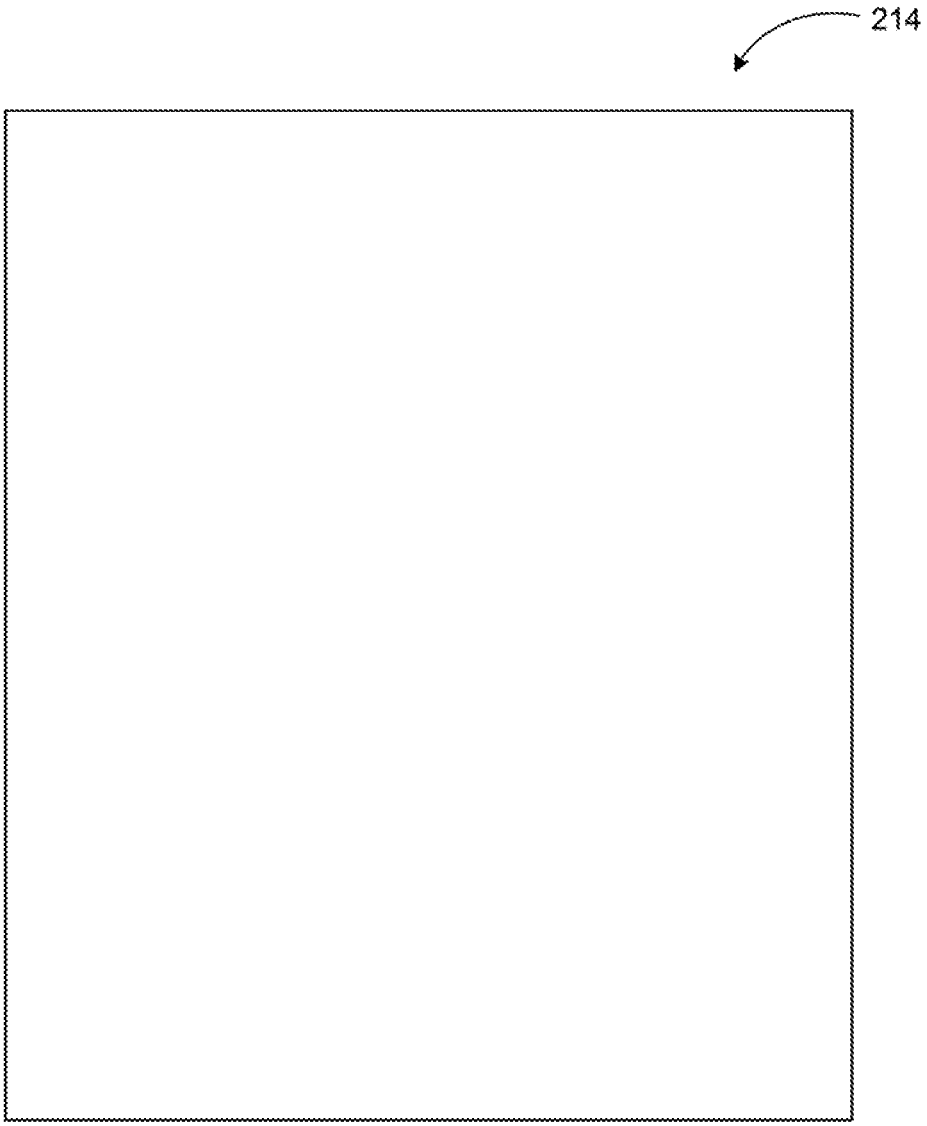

FIGS. 5A and 5B illustrate common gate and common base configuration implementations of the unity gain buffer of FIG. 2 and FIG. 3. As discussed previously, the unity gain buffer 214 coupled to the power transistor 204 and the error amplifier 206 may be configured to receive the first control signal from the error amplifier, and provide a second control signal to the power transistor 204. The second control signal may be provided without signal amplification or attenuation of the second control signal, which may provide stability to the IC under a variety of operating conditions, such as a range of load capacitance 216 values. For example, the load capacitance 216 values may range from a few pF to several hundred pF. The unity gain buffer 214 may be a transistor in a common base configuration or a transistor in a common gate configuration.

FIG. 5A shows a common gate configuration that may be implemented using a field effect transistor (FET), where an output voltage of the common gate configuration circuit may correspond to the second control signal provided from the unity gain buffer 214 to the power transistor 204. The common gate configuration circuit may receive an input voltage corresponding to the first control signal from the error amplifier 206 in FIG. 2.

FIG. 5B shows a common base configuration that may be implemented using a BJT circuit, where an output voltage of the common base configuration circuit may correspond to the second control signal provided from the unity gain buffer 214 to the power transistor 204. The common base circuit may receive an input voltage corresponding to the first control signal from the error amplifier 206 in FIG. 2.

According to some examples, voltage regulators are described. An example voltage regulator may include a power transistor configured to receive an input voltage from a voltage source and convert the input voltage to an output voltage, and a feedback loop configured to regulate the output voltage in response to a change of output voltage from a desired level caused by a change of a current consumed by a load or changes of other operating conditions. The feedback loop may include an error amplifier configured to determine and amplify a value difference between the output voltage or portion of the output voltage and a reference voltage. The feedback loop may also include a voltage divider, where an input of the voltage divider may be coupled to an output of the voltage regulator, and an output of the voltage divider may be coupled to an input of the error amplifier. The voltage divider may be configured to receive an output voltage of the voltage regulator, and generate voltage proportional to an input voltage of the voltage divider with a specific ratio. The feedback loop may further include a unity gain buffer coupled to the power transistor and the error amplifier. The unity gain buffer may be configured to receive a first control signal based on the output voltage of the error amplifier, and provide a second control signal to the power transistor without signal amplification or attenuation.

In other examples, a conductivity of the power transistor may be dependent on a level of the second control signal. The feedback loop may further include a compensation capacitor between an output of the error amplifier and the output of the voltage regulator, and a compensation capacitor between the unity gain buffer and the output of the voltage regulator. The voltage regulator may be implemented as an integrated circuit (IC). The error amplifier may be an operational trans-conductance amplifier (OTA). The unity gain buffer may be a transistor in a common base configuration or in a common gate configuration. The voltage divider may be a resistive divider.

In further examples, a size of the power transistor may be selected based on a maximum load current and a minimum input voltage requirement. The size of the power transistor may be further selected based on one or more design rules. The size of the power transistor may be further selected such that multiplication is enabled. A range of scaling factors may be identified for the power transistor, the unity gain buffer, the error amplifier, and a compensation capacitor, where coefficients of the scaling factors are determined by running a circuit simulation for one or more combinations of the scaling factors. The combination scaling coefficients may be selected based on target voltage regulator parameters.

According to some embodiments, voltage regulators are described. An example voltage regulator may include a power transistor configured to receive an input voltage from a voltage source and convert the input voltage to an output voltage, and a feedback loop configured to regulate the output voltage in response to a change of output voltage from a desired level caused by a change of a current consumed by a load or changes of other operating conditions. The feedback loop may include an error amplifier configured to determine and amplify a value difference between the output voltage or portion of the output voltage and a reference voltage. The feedback loop may also include a voltage divider, where an input of the voltage divider may be coupled to an output of the voltage regulator, and an output of the voltage divider may be coupled to an input of the error amplifier. The voltage divider may be configured to receive an output voltage of the voltage regulator, and generate voltage proportional to an input voltage of the voltage divider with a specific ratio. The feedback loop may further include a first unity gain buffer coupled to the power transistor and the error amplifier. The first unity gain buffer may be configured to receive a first control signal based on the output voltage of the error amplifier, and provide a second control signal to the power transistor without signal amplification or attenuation. The feedback loop may yet further include a second unity gain buffer coupled to the power transistor, where the second unity gain buffer may be configured to reduce an output voltage drop when the current consumed by the load is changed from a low current to a high current.

In other embodiments, the feedback loop may include a compensation capacitor coupled to the second unity gain buffer and the output of the power transistor. The first unity gain buffer may be a transistor in a common base configuration or a common gate configuration. The second unity gain buffer may be a transistor in a common base configuration or a common gate configuration.

According to some examples, voltage regulators are described. An example voltage regulator may include a power transistor configured to receive an input voltage from a voltage source and convert the input voltage to an output voltage, and a feedback loop configured to regulate the output voltage in response to a change of output voltage from a desired level caused by a change of a current consumed by a load or changes of other operating conditions. The feedback loop may include an error amplifier configured to determine and amplify a value difference between the output voltage or portion of the output voltage and a reference voltage. The feedback loop may also include a voltage divider, where an input of the voltage divider may be coupled to an output of the voltage regulator, and an output of the voltage divider may be coupled to an input of the error amplifier. The voltage divider may be configured to receive an output voltage of the voltage regulator, and generate voltage proportional to an input voltage of the voltage divider with a specific ratio. The feedback loop may further include a first unity gain buffer coupled to the power transistor and the error amplifier. The first unity gain buffer may be configured to receive a first control signal based on the output voltage of the error amplifier, and provide a second control signal to the power transistor without signal amplification or attenuation. The feedback loop may yet further include a second unity gain buffer coupled to the power transistor, where the second unity gain buffer may be configured to reduce an output voltage drop when the current consumed by the load is changed from a low current to a high current. The feedback loop may also include an overshoot suppressor circuit coupled to the load in a parallel orientation to the load, where the overshoot suppressor circuit may be configured to reduce an output voltage rise when the current consumed by the load is changed from a high current to a low current.

In other examples, the voltage regulator may be implemented as an IC. The first unity gain buffer may be a transistor in a common base configuration or a common gate configuration. The second unity gain buffer may be a transistor in a common base configuration or a common gate configuration.

There are various vehicles by which processes and/or systems and/or other technologies described herein may be effected (for example, hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

While various compositions, methods, systems, and devices are described in terms of "comprising" various components or steps (interpreted as meaning "including, but not limited to"), the compositions, methods, systems, and devices can also "consist essentially of" or "consist of the various components and steps, and such terminology should be interpreted as defining essentially closed-member groups."

The foregoing detailed description has set forth various embodiments of the devices and/or processes via the use of block diagrams, flowcharts, and/or examples. Insofar as such block diagrams, flowcharts, and/or examples contain one or more functions and/or operations, each function and/or operation within such block diagrams, flowcharts, or examples may be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, may be equivalently implemented in integrated circuits, as one or more computer programs running on one or more computers (for example, as one or more programs running on one or more computer systems), as one or more programs running on one or more processors (for example as one or more programs running on one or more microprocessors), as firmware, or as virtually any combination thereof, and that designing the circuitry and/or writing the code for the software and or firmware would be possible in light of this disclosure.

The present disclosure is not to be limited in terms of the particular embodiments described in this application, which are intended as illustrations of various aspects. Many modifications and variations can be made without departing from its spirit and scope Functionally equivalent methods and apparatuses within the scope of the disclosure, in addition to those enumerated herein, will be possible from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, systems, or components, which can, of course, vary. It is also to be understood that the terminology used herein is for the purpose of describing particular embodiments only, and is not intended to be limiting.

In addition, the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Versatile Disk (DVD), a digital tape, a computer memory, etc.; and a transmission type medium such as a digital and/or an analog communication medium (for example, a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein may be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that particular functionality is achieved. Hence, any two components herein combined to achieve a particular functionality may be seen as "associated with" each other such that the particular functionality is achieved, irrespective of architectures or intermediate components. Likewise, any two components so associated may also be viewed as being "operably connected", or "operably coupled", to each other to achieve the particular functionality, and any two components capable of being so associated may also be viewed as being "operably couplable", to each other to achieve the particular functionality. Specific examples of operably couplable include but are not limited to physically connectable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (for example, "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (for example, the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments are possible. The various aspects and embodiments disclosed herein are for purposes of illustration and are not intended to be limiting, with the true scope and spirit being indicated by the following claims.

What is claimed is:

1. A voltage regulator comprising:

a power transistor configured to receive an input voltage from a voltage source and convert the input voltage to an output voltage; and a feedback loop configured to regulate the output voltage in response to a change of output voltage from a desired level caused by a change of a current consumed by a load or changes of other operating conditions, the feedback loop comprising:

an error amplifier configured to:

determine a value difference between the output voltage or portion of the output voltage and a reference voltage; and amplify the value difference;

a voltage divider, wherein an input of the voltage divider is coupled to an output of the voltage regulator, and an output of the voltage divider is coupled to an input of the error amplifier, the voltage divider configured to:

receive an output voltage of the voltage regulator; and generate voltage proportional to an input voltage of the voltage divider with a specific ratio;

a first unity gain buffer coupled to the power transistor and the error amplifier, the first unity gain buffer configured to:

receive a first control signal based on the output voltage of the error amplifier; and provide a second control signal to the power transistor without signal amplification or attenuation; and a second unity gain buffer coupled to the power transistor, the second unity gain buffer configured to reduce an output voltage drop when the current consumed by the load is changed from a low current to a high current.

2. The regulator of claim 1, further comprising a compensation capacitor coupled to the second unity gain buffer and the output of the power transistor.

3. The regulator of claim 1, wherein the first unity gain buffer is a transistor in one of a common base configuration and a common gate configuration.

4. The regulator of claim 1, wherein the second unity gain buffer is a transistor in one of a common base configuration and a common gate configuration.

5. The regulator of claim 1, wherein a conductivity of the power transistor is dependent on a level of the second control signal.

6. The regulator of claim 1, further comprising a compensation capacitor between an output of the error amplifier and the output of the voltage regulator.

7. The regulator of claim 1, further comprising a compensation capacitor between the first unity gain buffer and the output of the voltage regulator.

8. The regulator of claim 1, wherein the error amplifier is an operational trans-conductance amplifier (OTA).

9. The regulator of claim 1, wherein the voltage divider is a resistive divider.

10. A voltage regulator comprising:

a power transistor configured to receive an input voltage from a voltage source and convert the input voltage to an output voltage; and a feedback loop configured to regulate the output voltage in response to a change of output voltage from a desired level caused by a change of a current consumed by a load or changes of other operating conditions, the feedback loop comprising:

an error amplifier configured to:

determine a value difference between the output voltage or portion of the output voltage and a reference voltage; and amplify the value difference;

a voltage divider, wherein an input of the voltage divider is coupled to an output of the voltage regulator, and an output of the voltage divider is coupled to an input of the error amplifier, the voltage divider configured to:

receive an output voltage of the voltage regulator; and generate voltage proportional to an input voltage of the voltage divider with a specific ratio;

a first unity gain buffer coupled to the power transistor and the error amplifier, the unity gain buffer configured to:

receive a first control signal based on the output voltage of the error amplifier; and provide a second control signal to the power transistor without signal amplification or attenuation;

a second unity gain buffer coupled to the power transistor, the second unity gain buffer configured to reduce an output voltage drop when the current consumed by the load is changed from a low current to a high current; and an overshoot suppressor circuit coupled to the load in a parallel orientation to the load, the overshoot suppressor circuit configured to reduce an output voltage rise when the current consumed by the load is changed from a high current to a low current.

11. The regulator of claim 10, wherein the voltage regulator is implemented as an integrated circuit (IC).

12. The regulator of claim 10, wherein the first unity gain buffer is a transistor in one of a common base configuration and a common gate configuration.

13. The regulator of claim 10, wherein the second unity gain buffer is a transistor in one of a common base configuration and a common gate configuration.

14. The regulator of claim 10, wherein a size of the power transistor is selected based on a maximum load current and a minimum input voltage requirement.

15. The regulator of claim 14, wherein the size of the power transistor is further selected based on one or more design rules.

16. The regulator of claim 14, wherein the size of the power transistor is selected such that multiplication is enabled.

17. The regulator of claim 10, wherein a range of scaling factors is identified for the power transistor, the unity gain buffer, the error amplifier, and a compensation capacitor.

18. The regulator of claim 17, wherein coefficients of the scaling factors are determined by running a circuit simulation for one or more combinations of the scaling factors.

19. The regulator of claim 18, wherein one of the one or more combinations of scaling coefficients is selected based on target voltage regulator parameters.

* * * * *